US008020306B2

(12) United States Patent
Grivas et al.

(10) Patent No.: US 8,020,306 B2
(45) Date of Patent: Sep. 20, 2011

(54) NON-MARRING HIGH-PRECISION MARKING AND MEASURING TOOL

(76) Inventors: Dimitrios E Grivas, Chicago, IL (US); Armenac Daniel, Chicago, IL (US)

( * ) Notice: Subject to any disclaimer, the term of this patent is extended or adjusted under 35 U.S.C. 154(b) by 264 days.

(21) Appl. No.: 12/360,252

(22) Filed: Jan. 27, 2009

(65) Prior Publication Data

US 2010/0186249 A1 Jul. 29, 2010

(51) Int. Cl.
*B43L 13/00* (2006.01)

(52) U.S. Cl. ..... 33/42; 33/668; 33/770

(58) Field of Classification Search ..... 33/42, 668, 33/755, 759, 761, 769, 770
See application file for complete search history.

(56) References Cited

U.S. PATENT DOCUMENTS

| | | | | |
|---|---|---|---|---|
| 4,255,856 | A | 3/1981 | Mackie | |
| 5,289,637 | A * | 3/1994 | Coffey | 30/294 |
| 5,379,524 | A * | 1/1995 | Dawson | 33/768 |
| 5,542,184 | A | 8/1996 | Beard | |
| 6,115,931 | A * | 9/2000 | Arcand | 33/668 |
| RE36,887 | E | 10/2000 | Goldman | |
| 6,442,860 | B1 * | 9/2002 | Williams et al. | 33/668 |
| 6,694,622 | B2 | 2/2004 | Kim | |
| 6,763,603 | B2 * | 7/2004 | Carrabino | 33/770 |
| 6,912,799 | B1 * | 7/2005 | Smith | 33/770 |
| 6,931,734 | B2 * | 8/2005 | Elder et al. | 33/42 |
| 7,260,898 | B2 | 8/2007 | Snelson | |
| 7,266,854 | B1 | 9/2007 | Gomez | |
| 2003/0019116 | A1 | 1/2003 | DeWall | |

* cited by examiner

*Primary Examiner* — G. Bradley Bennett
*Assistant Examiner* — Tania C Courson
(74) *Attorney, Agent, or Firm* — Patula & Associates, P.C.

(57) ABSTRACT

The invention is an tool for measuring and marking wall sheathing materials such as drywall, veneer, paneling, and various other wall sheathing materials. The tool provides rolling contact to protect finished surfaces and also maintains parallel positioning to maximize accuracy.

20 Claims, 8 Drawing Sheets

NON-MARRING HIGH-PRECISION MARKING AND MEASURING TOOL

The present invention relates to hand tools and systems for measuring and marking building materials, and relates particularly to tools for measuring and marking wall sheathing materials such as drywall, veneer, paneling, and various other wall sheathing materials.

In many applications, wall sheathing requires marking at a specific distance from an existing sheathing edge. It is known in the prior art to utilize a conventional tape measure for such marking, by holding the tape measure housing against the existing edge and extending the tape end to the specific distance from the edge. A marking implement, for example a pencil or utility knife, is held against the extended tape end, and both the tape measure and the marking implement are moved in concert, with the tape measure housing dragging along the existing edge, so that the marking implement marks a line on the wall sheathing at the target distance from the existing edge.

Such prior art can be useful for approximate marking on unfinished wall sheathing, however the prior art has drawbacks that render them unsatisfactory for use on finished sheathing such as painted drywall, fine wood veneer and paneling, and other finished wall sheathing materials.

For example, inaccuracies in the measured distance can arise due to variations in connecting the marking implement and the tape measure, due to inconsistent spacing between the implement and the extended end, due to variable angles between the tape and the wall sheathing, and due as well to other variations.

Also, finished wall sheathing requires careful handling to prevent damaging the finished surface of the wall sheathing. Sliding the tape measure along the existing edge and along a top surface of the wall sheathing, and sliding the tape itself across the top surface of the wall sheathing can cause marring, scuffing, and various undesirable marking of the top surface.

There is a need for a tool that enables accurate measuring and marking of finished wall sheathing without damaging the finished surface of the wall sheathing.

SUMMARY OF THE INVENTION

In one aspect of the present invention, a non-marring, high precision, measuring and marking tool comprises a corner tracker in use contacting a workpiece edge and a workpiece top surface while the corner tracker moves along the workpiece edge. The corner tracker comprises an edge cylinder that is a right, circular cylinder with a concentric edge cylinder axis. The edge cylinder in use rotates about the edge cylinder axis and rolls along the workpiece edge. The corner tracker further comprises a top cylinder that is a right, circular cylinder with a concentric top cylinder axis. The top cylinder axis is substantially perpendicular to the edge cylinder axis. The top cylinder in use rotates about the top cylinder axis and rolls along the workpiece top surface with the top cylinder axis parallel to the workpiece top surface. The top cylinder in use biases the corner tracker to move along the top surface substantially perpendicularly to the top cylinder axis and perpendicularly to the edge cylinder axis. The tool further comprises a distance sensor and a target. The distance sensor can be fixed to and move with the corner tracker. The distance sensor in use extends across the workpiece top surface and connects to the target. The distance sensor is positioned with respect to the top cylinder so that in use the distance sensor is spaced apart from the top surface and projects substantially parallel to the top surface. The distance sensor is aligned with respect to the edge cylinder to sense a target distance across the top surface between the workpiece edge and the target. The distance sensor in use senses the target distance. The tool further comprises a distance indicator displaying the target distance, and a marking implement in use aligned with the target and contacting the workpiece top surface. The marking implement in use marks the workpiece top surface at the target distance from the workpiece edge as the corner tracker moves along the workpiece edge.

In another aspect of the present invention, the tool comprises a corner tracker in use guiding the tool along a workpiece edge while a measuring tape, extending away from the corner tracker across the workpiece, accurately positions a utility knife to mark the workpiece at a target distance from the workpiece edge. The corner tracker comprises an edge cylinder that is a right, circular cylinder with an concentric edge cylinder axis. The edge cylinder in use rotates about the edge cylinder axis and rolls along the workpiece edge. The corner tracker further comprises a top cylinder that is a right, circular cylinder with a concentric top cylinder axis. The top cylinder axis is substantially perpendicular to the edge cylinder axis. The top cylinder in use rotates about the top cylinder axis and rolls along the workpiece top surface with the top cylinder axis parallel to the workpiece top surface. The top cylinder in use biases the corner tracker to move along the top surface substantially perpendicularly to the top cylinder axis and perpendicularly to the edge cylinder axis. The measuring tape comprises a flexible strip that is extendable outwards from a tape housing and retractable into a tape housing. The flexible strip is positioned with respect to the top cylinder so that in use the flexible strip is spaced apart from the top surface and projects substantially parallel to the top surface. The flexible strip terminates outside the tape housing at a distal end tab. The distal end tab in use extends towards the workpiece top surface to within a sighting gap. The flexible strip has graduated distance markings, the markings being aligned to indicate marked distances from the distal end tab. The distal end tab engages the utility knife via a pin slot in the distal end tab. The utility knife comprises a utility knife blade having a first headed pin fixed to and extending outwards from the blade. The first headed pin engages the pin slot to align the knife blade with the distal end tab while the knife blade marks the workpiece top surface at the distance from the edge indicated by the measuring tape. The measuring tape further comprises a knife handle that includes an internal passage for slidably extending and slidably retracting the utility knife blade. The knife handle further has at least one pin aperture along the internal passage, the aperture configured to accommodate the first headed pin when the knife blade slides out of the handle along the internal passage.

These and other features, aspects and advantages of the present invention will become better understood with reference to the following drawings, description and claims.

DRAWINGS

DETAILED DESCRIPTION OF THE INTENTION

Figure 1:
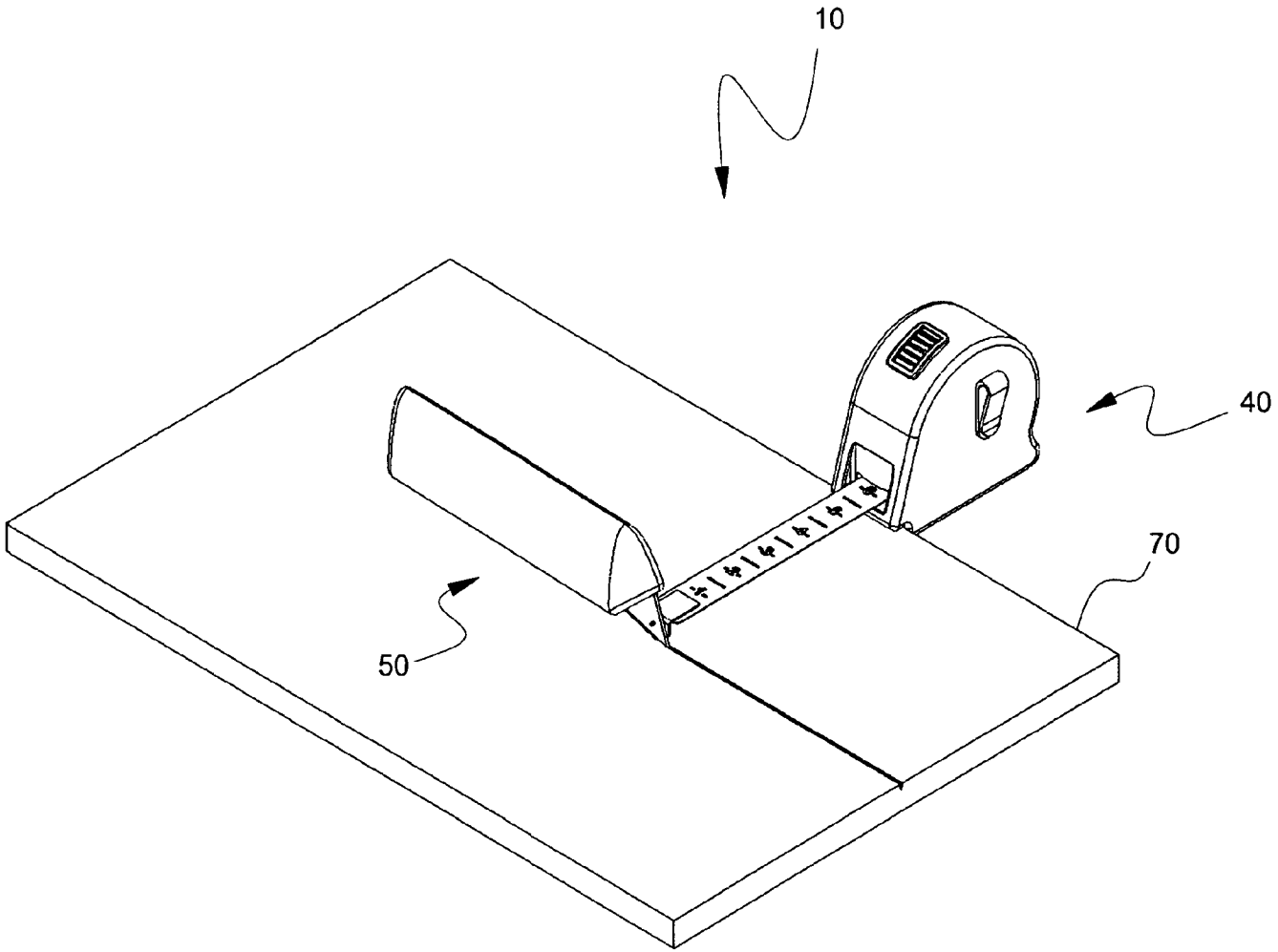
FIG. 1 is an isometric view an embodiment of the tool in use marking a workpiece.

The invention is a non-marring, high precision, measuring and marking tool. The tool is especially useful for measuring and marking finished wall sheathing such as paneling, drywall, and various other sheathing materials. The tool can utilize a utility knife to mark by scoring, for example to score the sheathing. Alternatively, the tool can be used with a pen or pencil to mark the sheathing with a line.

When non-marring, high-precision measuring and marking are not required, the tool can, without requiring modification, function as a conventional measuring tape.

The tool can be used to accurately measure a target distance from a workpiece edge, and then linearly mark the workpiece top surface at that target distance by moving the tool along the workpiece edge while marking the surface. Accurate alignment can be critical to high precision measuring, and the tool is configured so that both the workpiece edge and the workpiece top surface are precisely and repeatably aligned with respect to the tool in order to maximize marking accuracy.

The tool can have a corner tracker that aligns the tool on a workpiece for precision marking. The corner tracker can move along a workpiece edge to enable marking the workpiece at the target distance from the edge. The corner tracker is configured to move along the workpiece without scratching, scuffing, or otherwise marring finished workpiece surfaces.

The corner tracker can have at least one edge cylinder. The edge cylinder can be a right, circular cylinder and can have a concentric edge cylinder axis. In use, the edge cylinder rotates about the edge cylinder axis and can roll along the workpiece edge. The edge cylinder provides non-marring rolling contact with the workpiece edge as the corner tracker moves along the workpiece edge.

The corner tracker can have at least one top cylinder. The top cylinder can be a right, circular cylinder and can have a concentric top cylinder axis. In use, the top cylinder rotates about the top cylinder axis and rolls along the workpiece top surface with the top cylinder axis substantially parallel to the top surface. The top cylinder provides non-marring rolling contact with the top surface as the corner tracker moves along the workpiece edge.

The top cylinder axis can be substantially perpendicular to the edge cylinder axis so that in use the top cylinder and the edge cylinder can positively and consistently locate the corner tracker with respect to the top surface and the edge.

"Substantially" as used here and throughout, is a qualifier that takes into account minor discrepancies that arise due to the limitations of manufacturing processes, clearance fits between assembled components, and other minor variations in shape, size, and position.

Due to the characteristics of a right, circular cylinder rotating about a concentric cylinder axis, the top cylinder in use can bias the corner tracker to move along the top surface substantially perpendicularly to the top cylinder axis and perpendicularly to the edge cylinder axis. Specifically, moving the top cylinder non-perpendicularly to the surface upon which the cylinder is rolling can cause asymmetric loads on the cylinder as one end of the cylinder attempts to roll along a longer path than another end of the cylinder. The asymmetric loads increase drag as the cylinder rolls across the top surface and can feed back tactilely to a user as roughness. In such circumstances, the cylinder is biased to roll along a straight path that is perpendicular to the cylinder axis.

The top cylinder and the edge cylinder can each comprise non-marring materials such as plastic, hard rubber, wood, and various materials. The top cylinder and the edge cylinder can comprise different materials.

The tool can have a distance sensor fixed to and moving with the corner tracker. The distance sensor provides distance information to facilitate marking the workpiece at the target distance from the corner tracker.

The tool can comprise a distance target. The distance sensor can provide distance information about the position of the distance target with respect to the corner tracker contacting the workpiece edge. In use, the target is spaced apart from the corner tracker across the workpiece top surface at a target distance.

The distance sensor can project across the workpiece top surface and connect to the target. The distance sensor can be positioned with respect to the top cylinder so that the distance sensor is spaced apart from the top surface and so that the distance sensor projects substantially parallel to the top surface.

Spacing apart the distance sensor from the top surface can minimize any marking and marring to the top surface due to inadvertent contact between the distance sensor and the top surface.

Projecting the distance sensor parallel to the top surface can minimize measurement errors arising from varying distances along a parallel path across the top surface and along a non-parallel path across the top surface.

The distance sensor can be aligned with respect to the edge cylinder so that in use the distance sensor senses the target distance between the workpiece edge and the target across the top surface.

The distance sensor can comprise a marked tape, where the tape senses the target distance by exposing graduated markings as the tape extends to connect to the target. Alternatively, the distance sensor can comprise a flexible strip with a motion sensor, where the motion sensor senses the target distance extended as the strip connects to the target. Alternatively, the distance sensor can comprise a wire wound onto a reel, where the reel senses distance via tracking reel rotation as the reel unwinds to extend the wire to connect to the target. The distance sensor can comprise various tapes, strips, wires, cables and other components so long as the distance sensor can connect to the target and sense the target distance.

The tool can comprise a distance indicator for displaying the target distance sensed by the distance sensor. The distance indicator can comprise a digital display. Alternatively, the distance indicator can comprise graduated markings on a measuring tape. Alternatively, the distance indicator can comprise various display and indicators and combinations thereof so long as the distance indicator can indicate the target distance.

The tool can have a marking implement. In use, the marking implement can be aligned with the distance target to ensure the workpiece is marked at the distance displayed by the distance indicator. The marking implement can contact the workpiece top surface and mark the top surface at the target distance as the corner tracker moves along the workpiece edge.

"Mark" and "marking" as used here and throughout can include marking with a visual sign, can include cutting the top surface, and can include various other techniques for indicating the target distance on the top surface.

Figure 2:
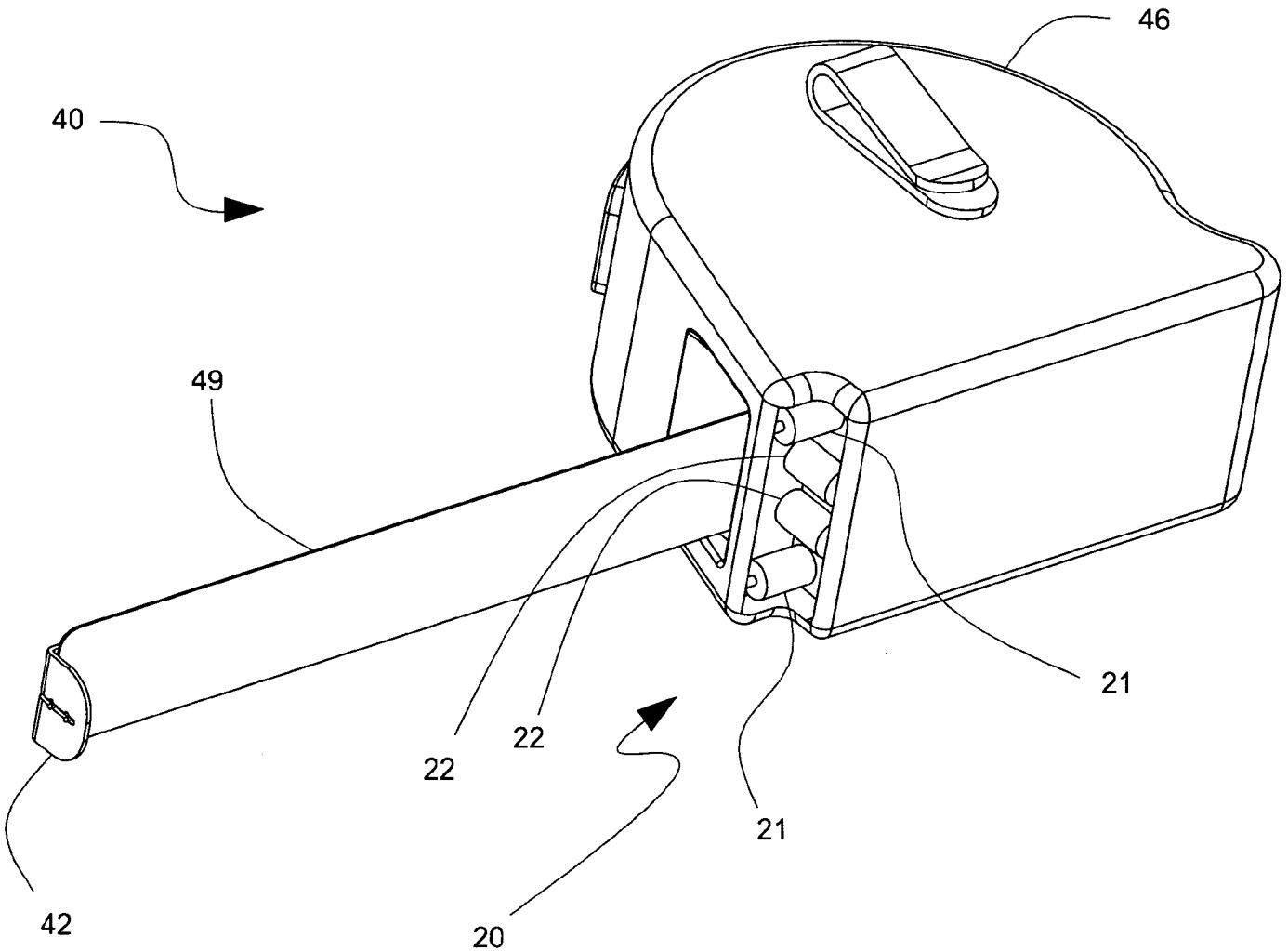
FIG. 2 is a view of the tool showing an embodiment of a corner tracker.
Figure 3:
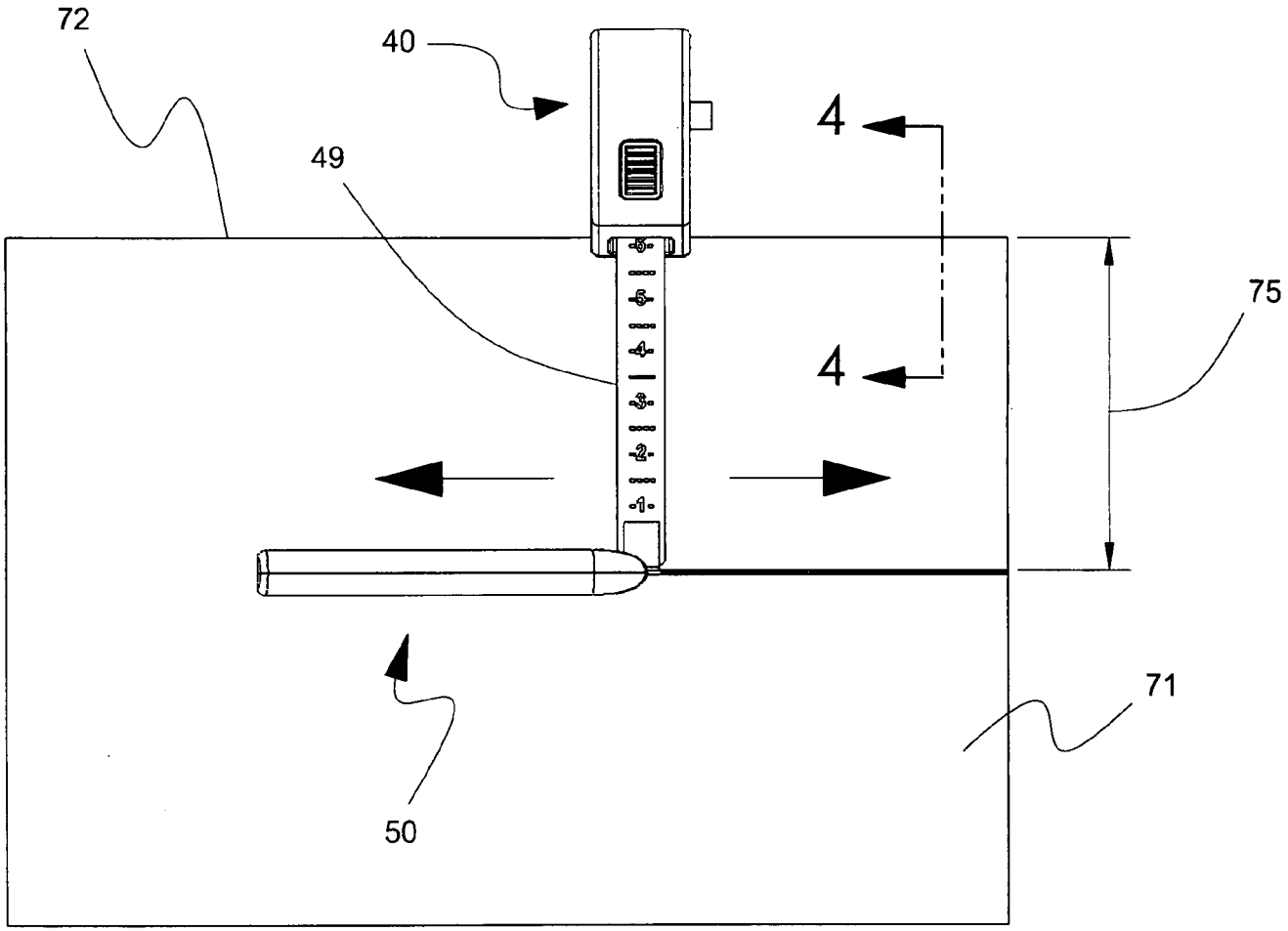
FIG. 3 is a top view of the tool in use marking the workpiece.

One embodiment of the invention, the tool 10, is shown in FIGS. 1, 2, and 3. The tool 10 is shown marking the workpiece 70.

The tool 10 can comprise a measuring tape 40 that can extend across the top surface 71 and connect to a target fixed to a utility knife blade 51 mounted in a utility knife 50. The measuring tape 40 can have a tape housing 46. The measuring tape can comprise a distance sensor comprising a flexible strip 49 with a distal end tab 42. The flexible strip 49 can project across the workpiece top surface and connect to the target via the distal end tab 42. The corner tracker 20 can connect to the housing 46 so that the corner tracker 20 is positionally fixed with respect to the flexible tape 49.

Figure 4:
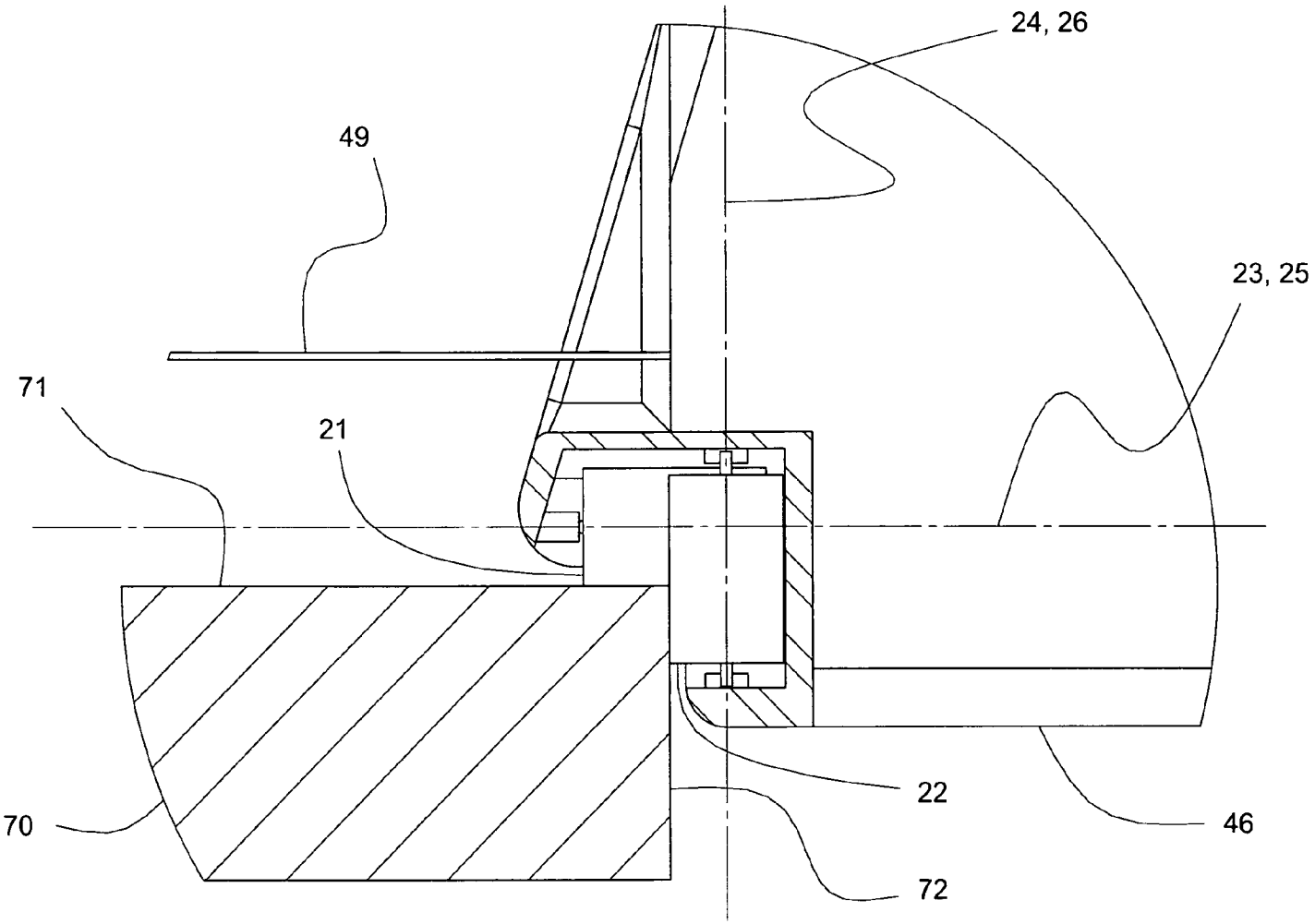
FIG. 4 is a side section view of the tool along line 4-4 showing a top cylinder and an edge cylinder contacting the workpiece top surface and edge, respectively.
Figure 9:
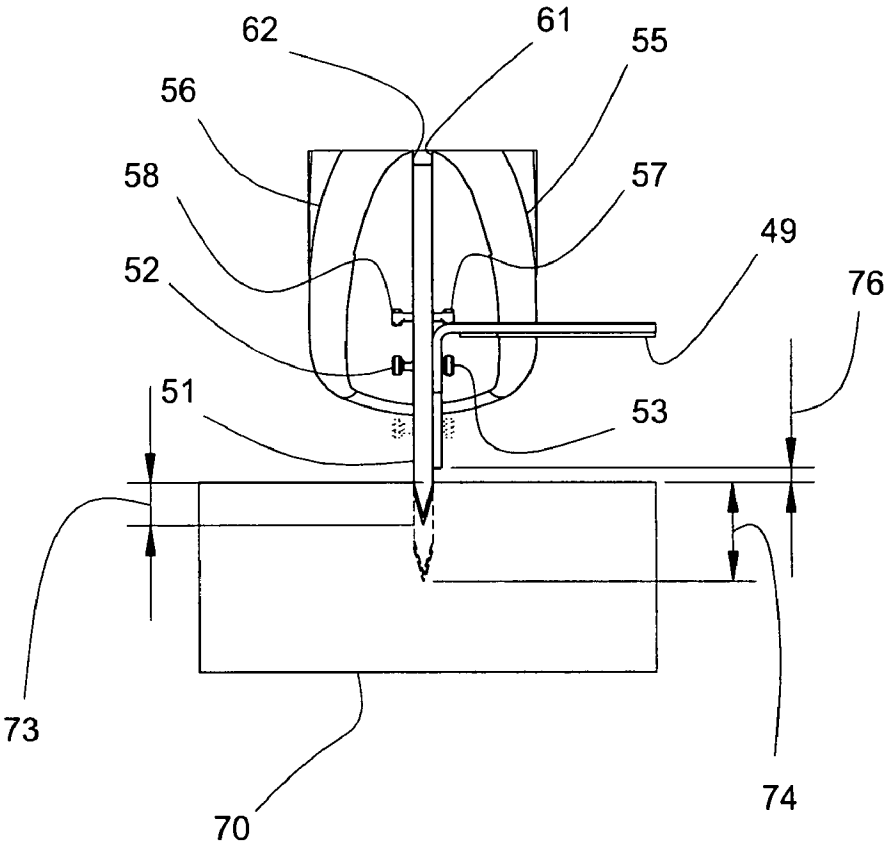
FIG. 9 is a front view of the utility knife in use cutting a workpiece at a first cut depth and at a second cut depth.

In FIGS. 2 and 4, the corner tracker 20 is shown positioning the measuring tape 40 with respect to the workpiece 70 and contacting both the workpiece edge 72 and the workpiece top surface 71. As in every embodiment, the corner tracker 20 can enable the tool 10 to move along the workpiece edge 72 while marking the top surface 71 without otherwise marring the top surface 71.

The corner tracker can have a top cylinder and an edge cylinder, and the corner tracker can have more than one top cylinder and more than one edge cylinder. The corner tracker 20 in the tool 10, for example, can have a first top cylinder 21 with a first top cylinder axis 23 and a second top cylinder 21 with a second top cylinder axis 23, and a first edge cylinder 22 with a first edge cylinder axis 24 and a second edge cylinder 22 with a second edge cylinder axis 24.

The first top cylinder axis 23 can be parallel to the second top cylinder axis 23 and the first top cylinder axis 23 and the second top cylinder axis 23 can define a top plane 25. The first edge cylinder axis 24 can be parallel to the second edge cylinder axis 24 and the first edge cylinder axis 24 and the second edge cylinder axis 24 can define an edge plane 26. The top plane 25 can be substantially perpendicular to the edge plane 26.

In the tool 10, the distance indicator can comprise graduated markings 48 on the flexible strip 49. The markings 48 can be aligned with the distal end tab 42 so that the markings 48 indicate distances along the flexible strip 49 from the end tab 42. In the tool 10, the last graduated marking that is visible outside the housing 46 can indicate the distance from the corner tracker 20 to the end tab 42.

Alternatively, the distance indicator can comprise an electronic digital display. The digital display can display distances from the corner tracker to the end tab. The digital display can be fixed to the tape housing and can be positioned remotely to enable reading the digital display from various locations. The distance indicator can comprise various indicators that display the distance separating the target and the corner tracker.

The flexible strip 49 can be retractable into and extendable outwards from the housing 46. In use, the flexible strip 49 can extend outwards to connect to the target. The distal end tab 42 is positioned on the flexible strip 49 outside the housing 46. The distal end tab 42 helps the flexible strip 49 to extend substantially parallel to the top surface 71 by limiting flexible strip movement toward the top surface 71.

FIG. 4 shows the corner tracker 20 in use in contact with the top surface 71 and the edge 72. In use, the edge cylinders 22 rotate about their respective edge cylinder axes 24 and can roll along the workpiece edge 72. The edge cylinders 22 provide non-marring rolling contact with the workpiece edge 72 as the corner tracker 20 moves along the workpiece edge 72. In use, the top cylinders 21 rotate about their respective top cylinder axes 23 and can roll along the workpiece top surface 71. The top cylinders 21 provide non-marring rolling contact with the top surface 71 as the corner tracker 20 moves along the edge 72. The flexible strip 49 can be positioned with respect to the top cylinders 21 so that in use the flexible strip 49 is spaced apart from the top surface 71 and projects substantially parallel to the top surface 71.

With the tool 10 in place on the workpiece 70, the flexible strip 49 can project across the workpiece top surface 71 and connect to the target. In the tool 10, the target can be a first headed pin 53 fixed to and moving with the utility knife blade 51. The flexible strip 49 with the distal end tab 42 can extend outwards from the tape housing 46 to the target distance 75 and preferably be locked in position with the first headed pin 53 connected with the distal end tab 42. The corner tracker 20 ensures that the flexible strip 49 is aligned with respect to the workpiece edge 72 to accurately sense the target distance 75 across the top surface 71 between the workpiece edge and the target. The corner tracker 20 ensures that the flexible strip 49 is spaced apart from the top surface 71.

Figure 5:
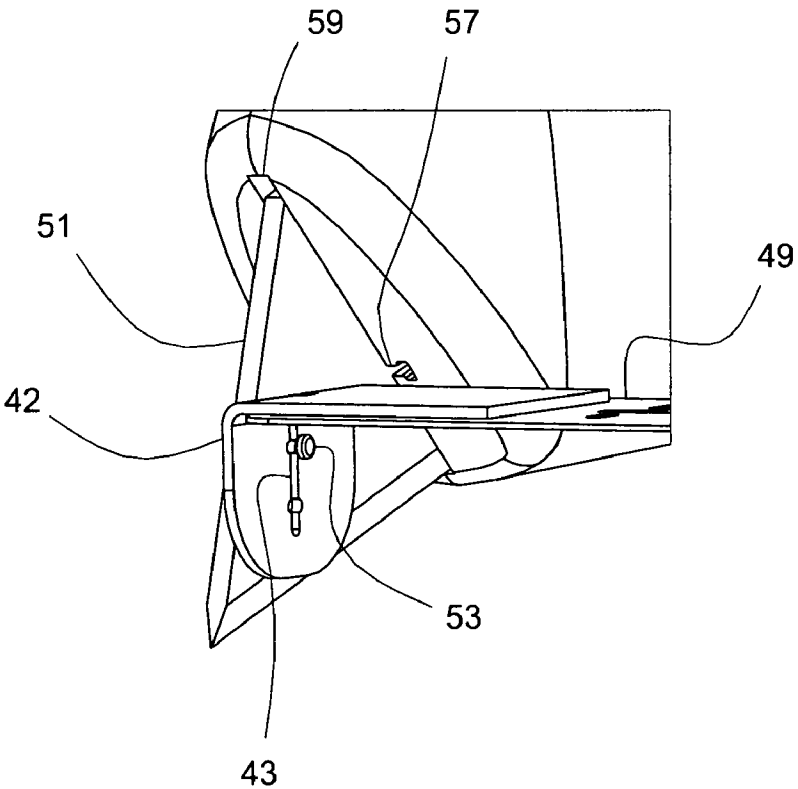
FIG. 5 is a view of the utility knife with a headed pin engaged with the pin slot.
Figure 6:
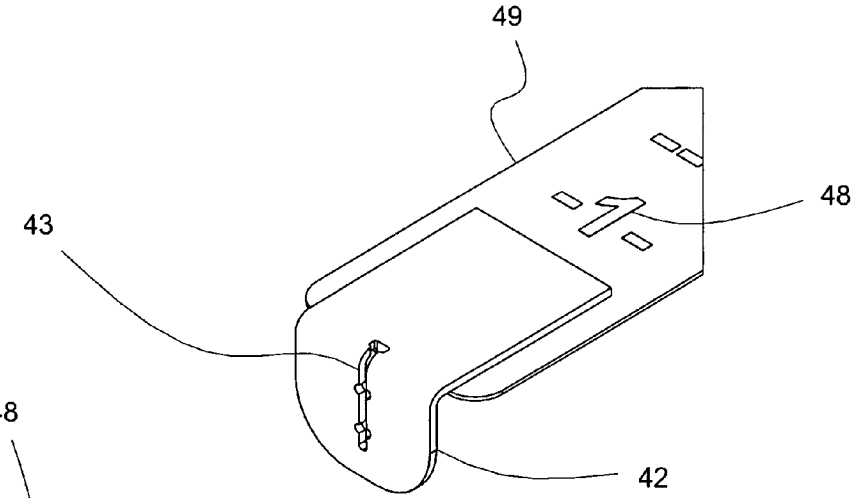
FIG. 6 is an isometric view of a flexible strip with a distal end tab.
Figure 8:
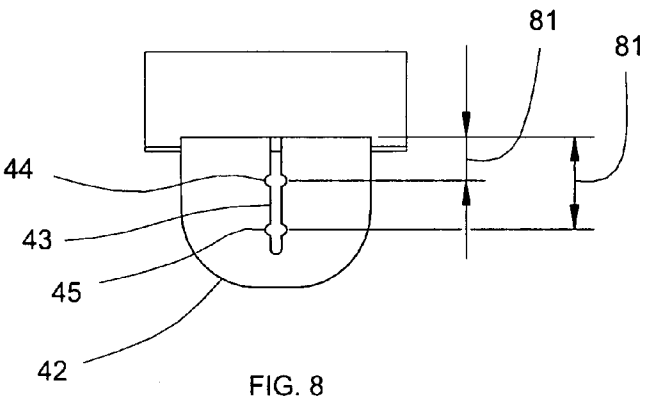
FIG. 8 is a front view of the distal end tab showing the pin slot with notches.
Figure 7:
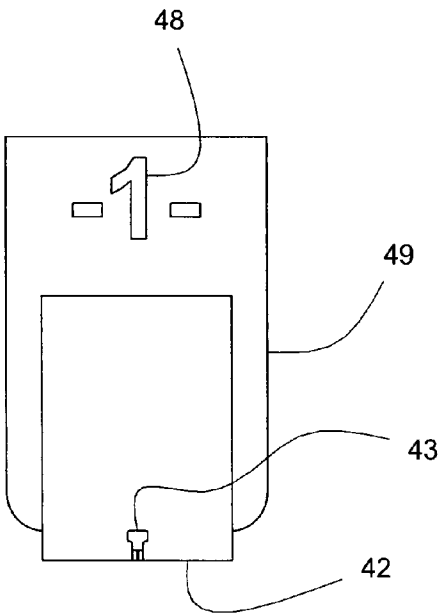
FIG. 7 is a top view of the flexible strip and distal end tab.

As shown in FIG. 5, the flexible strip 49 can connect with the first headed pin 53 via the distal end tab 42 by engaging the first headed pin 53 with a pin slot 43. With the first headed pin 53 engaged in the pin slot 43, the utility knife blade 51 can be aligned to mark the workpiece top surface 71 at the target distance from the workpiece edge 72.

The first headed pin 53 can comprise a pin shaft extending outward from a side of the utility knife blade 51. The first headed pin 53 can further comprise an oversized head connected to the shaft distal the utility knife blade 51. Optimally, the space between the utility knife blade and the oversized head can be about the thickness of the distal end tab at the pin slot. Marking accuracy can be maximized when the headed pin provides a close fit between the utility knife blade and the distal end tab. Preferably, the pin shaft can extend less than 1/128" further than the thickness of the distal end tab at the pin slot. A headed pin can be connected to various other elements, for example a marking implement holder.

In use, the distal end tab 42 angles towards the top surface 71 to within a sighting gap 76. The sighting gap 76 provides a visual reference to facilitate holding the flexible strip 49 parallel to the top surface 71. By watching the sighting gap 76 and exerting sufficient force to maintain the sighting gap 76 at a consistent size, a user can more easily maintain the position of the distal end tab 42 with respect to the top surface 71. A sighting gap measuring between about 1/32" and about 1/16" provides a suitable size gap for a user having average visual acuity. A sighting gap that is smaller than 1/32" and a sighting gap that is larger than 1/16" can also be utilized.

As shown in FIGS. 6, 7, 8, and 9, the distal end tab 42 can angle substantially perpendicularly towards the top surface 71. Similarly, the pin slot 43 extends along the distal end tab 42 towards the top surface 71. The distal end tab can angle at various angles including an oblique angle.

The pin slot 43 can comprise a first notch 44 positioned at a first offset distance 81 along the pin slot 43. The first notch 44 enables cutting the workpiece 70 at a first cut depth 73 by engaging the first headed pin 53 at the first offset distance 81. The first notch 44 facilitates positioning the flexible strip 49 parallel to the top surface 71 by fixing the position of the flexible strip 49 with respect to the utility knife blade 51 as the blade 51 cuts at the first cut depth 73 and the user maintains the sighting gap 76.

Additionally, the pin slot 43 can comprise a second notch 45 positioned at a second offset distance 82 along the pin slot 43. The second notch 45 enables cutting the workpiece 70 at a second cut depth 74 by engaging the first headed pin 53 at the second offset distance 74. The first and second notches facilitate cutting the workpiece at different depths while still positioning the flexible strip 49 parallel to the top surface 71.

The connection between the first headed pin 53 and the distal end tab 42 via the pin slot 43 provides an important and recognizable flexibility to the tool 10. The unique characteristics of the connection between the headed pin and the pin slot facilitate rotation of the marking implement about the pin shaft without sacrificing close alignment between the marking implement and the distal end tab and without twisting the flexible tape.

For example, when the first headed pin 53 is fixed to the utility knife blade 51 and engaged with the pin slot 43, a user can make rotational correction to the utility knife blade 51 while scoring the workpiece 70. In use, a user can visually monitor the size of the sighting gap 76 and the cut depth, and can receive tactile feedback from the utility knife blade 51 as it scores along the top surface 71. In response, a user can make small rotational adjustments to the utility knife blade position to facilitate proper scoring of the workpiece 70 and while still scoring the workpiece 70 with maximum precision at the target distance 75.

Pin accommodation features on the tape housing 46 can further enhance the connection between the first headed pin 53 and the distal end tab 42. For example, when the flexible strip 49 is retracted, the distal end tab 42 can rest against the tape housing 46. A pin compartment located on the housing 46 adjacent to the pin slot 43 can enable a user to connect the first headed pin 53 to the distal end tab 42 while the flexible strip 49 is fully retracted, and then extend the flexible strip by simply moving the utility knife blade 51, to which the first headed pin 53 is fixed, to the target distance 75. As such, the pin compartment can reduce the number of steps necessary to accurately measure and mark using the tool 10. The pin compartment can comprise a concavity in the surface of the housing 46 and can be a void space positioned behind the distal end tab 53.

In the tool 10, the marking implement can be the utility knife 50 comprising the blade 51. The target of the tool 10 can comprise the first headed pin 53 fixed to and extending outwards from a side of the utility knife blade 51. The target can further comprise a second headed pin 52 fixed to and extending outwards from an opposite side of the utility knife blade. The utility knife blade 51 engages the pin slot 43 with the first headed pin 53 for right-handed use and can engage the pin slot 43 with the second headed pin 52 for left-handed use.

The utility knife 50 can further comprise a handle 54 configured to hold the utility knife blade 51 within an internal passage 59. The utility knife blade 51 can extend from and retract into the handle 54 by moving along the internal passage 59.

The handle 54 can further comprise a left handle half 55 and a right handle half 56. The left handle half 55 can include a left internal passage component 61 and a left pin aperture 57. The right handle half 56 can include a right internal passage component 62 and a right pin aperture 58.

The handle 54 can be configured so that, with the left handle half 55 and the right handle half 56 assembled together, the left internal passage component 61 and the right internal passage component 62 combine to provide the internal passage 59 for holding the utility knife blade 51. Furthermore, the left pin aperture 57 and the right pin aperture 58, when assembled, are positioned to accommodate the first headed pin 53 and the second headed pin 52, respectively, while the utility knife blade 51 moves out of the handle along the internal passage 59.

Figure 10:
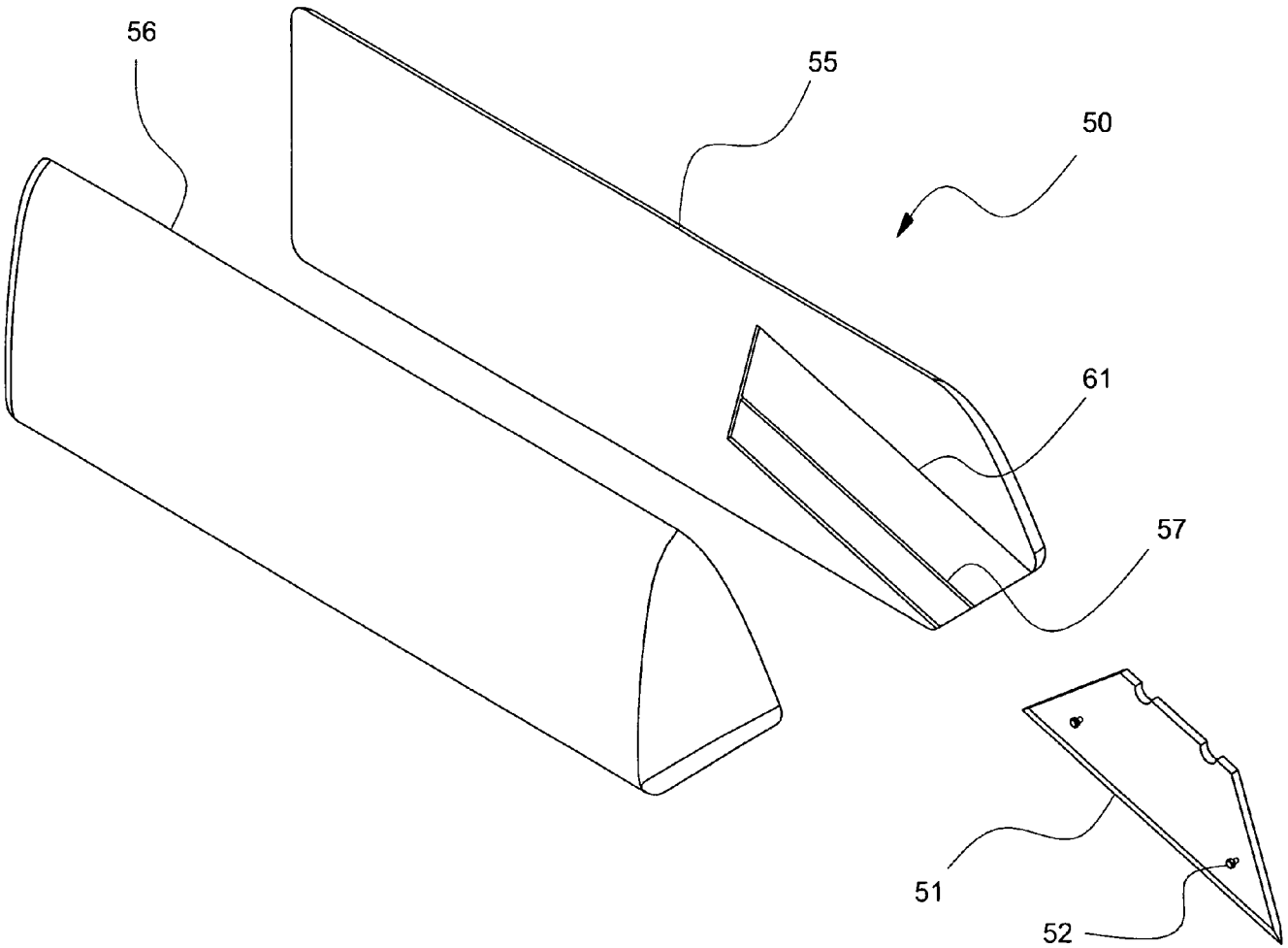
FIG. 10 is an exploded view of an embodiment of a utility knife.
Figure 12:
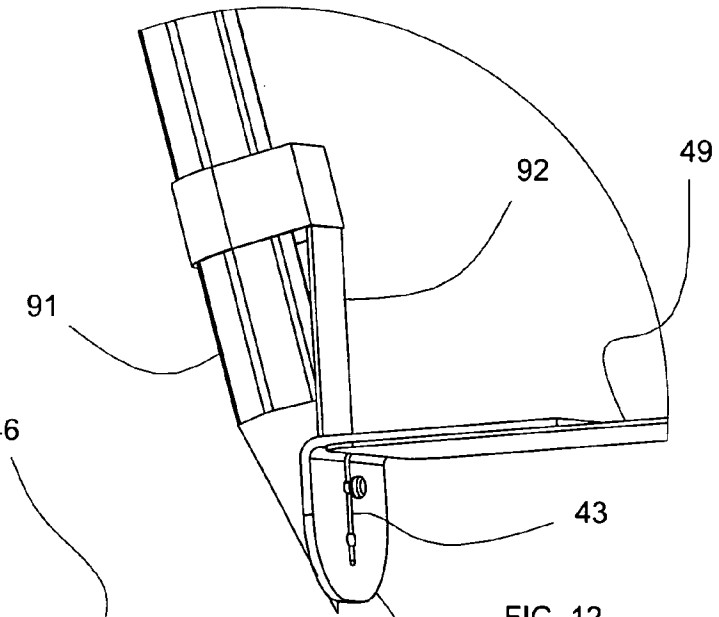
FIG. 12 is a detail view within line 12-12 of the pencil holder with a headed pin engaging the pin slot.

The pin apertures can have the elongate configurations as seen in FIG. 10. Alternatively the pin apertures can have short configurations, for example where the internal passage is sized to accommodate the headed pins and the pin apertures are in use only to pass the pins from within the passage to outside of the handle. Alternatively, the pin apertures can be envisioned having various other configurations so long as they enable the utility blade to move out of the handle along the internal passage.

Figure 11:
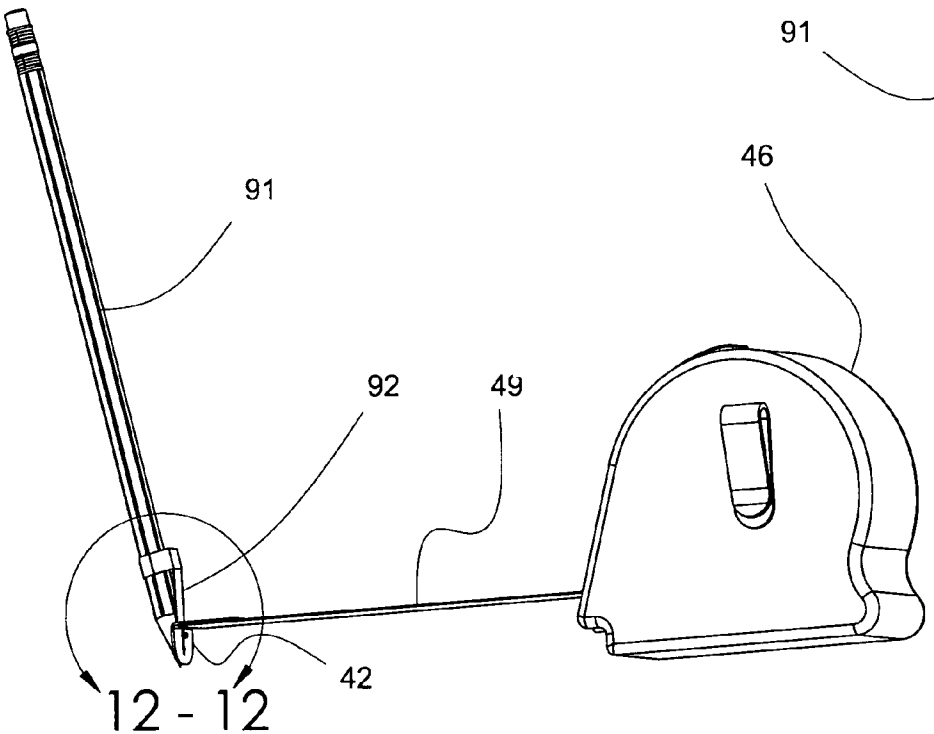
FIG. 11 is a view of an embodiment of the tool with a pencil and pencil holder.

The marking implement can be a utility knife blade, as described above, and the marking implement can be a marker, for example a pen and a pencil. As seen in FIG. 11, the marking implement can comprise a marker 91 positioned in a marking implement holder 92. The marking implement holder connects to the distal end tab via the first headed pin 53 engaging the pin slot 43.

The invention claimed is:

1. A tool used in connection with a workpiece having a top surface and an edge surface, the tool comprising:

a housing;

a measuring tape selectively extendible from the housing; and a corner tracker formed in the housing below the measuring tape, wherein the corner tracker is defined by a horizontal portion adapted to extend over and slideably abut against the top surface and a vertical portion adapted to extend over and slidably abut against the edge surface of the workpiece.

2. The tool of claim 1, wherein the corner tracker comprises at least one top cylinder mounted in the horizontal portion of the corner tracker and at least one edge cylinder mounted in the vertical portion of the edge tracker, wherein the axis of rotation of the at least one top cylinder and the axis of rotation of the at least one edge cylinder are perpendicular.

3. The tool of claim 1, wherein the corner tracker further comprises a calibration system.

4. A tool used in connection with a workpiece having a top surface and an edge surface, the tool comprising:

a housing;

a measuring tape selectively extendible from the housing, wherein the measuring tape includes an end tab having a vertical slot for engaging a workpiece marking implement; and a corner tracker formed in the housing below the measuring tape, wherein the corner tracker is defined by a horizontal portion adapted to extend over and slideably abut against the top surface and a vertical portion adapted to extend over and slidably abut against the edge surface of the workpiece.

5. The tool of claim 4, wherein the corner tracker comprises at least one top cylinder mounted in the horizontal portion of the corner tracker and at least one edge cylinder mounted in the vertical portion of the edge tracker, wherein the axis of rotation of the at least one top cylinder and the axis of rotation of the at least one edge cylinder are perpendicular.

6. The tool of claim 4, wherein the workpiece marking implement is a knife having a blade, and wherein the blade has affixed thereto at least one pin, wherein the pin selectively engages the vertical slot to removably secure the knife to the measuring tape.

7. The tool of claim 6, wherein the blade has a first side and a second side, and wherein a first pin is affixed to the first side of the blade, and a second pin is affixed to the second side of the blade.

8. The tool of claim 6, wherein the pin comprises a neck portion and a head portion, and wherein the end tab comprises a horizontal portion and a vertical portion, wherein the horizontal portion of the end tab includes a slot for receiving the head portion of the pin therethrough, and the vertical portion of the end tab includes a slot for receiving the neck portion of the pin therein.

9. The tool of claim 4, wherein the workpiece marking implement is a writing implement or a writing implement holder, and wherein the writing implement or the writing implement holder has affixed thereto at least one pin, wherein the pin selectively engages the vertical slot to removably secure the writing implement or the writing implement holder to the measuring tape.

10. The tool of claim 4, wherein the corner tracker further comprises a calibration system providing for a precise measurement from the edge surface of the workpiece to the marking implement.

11. The tool of claim 4, wherein the vertical slot includes a plurality of notches for selectively engaging the pin at one of a plurality of depths in the slot.

12. A tool used in connection with a workpiece having a top surface and an edge surface, the tool comprising in combination:

a measuring device having:

a housing;

a measuring tape selectively extendible from the housing, wherein the measuring tape includes an end tab having a vertical slot for engaging a workpiece marking implement; and a corner tracker formed in the housing below the measuring tape, wherein the corner tracker is defined by a horizontal portion adapted to extend over and slideably abut against the top surface and a vertical portion adapted to extend over and slidably abut against the edge surface of the workpiece; and a workpiece marking implement having:

a marking device for engaging the workpiece; and a pin affixed to and extending from the marking device, wherein the pin is adapted to be removably received in the vertical slot of the end tab of the measuring tape to selectively affix the workpiece marking implement to the measuring device, wherein the vertical slot prevents lateral movement of the marking device relative to the measuring device.

13. The tool of claim 12, wherein the corner tracker comprises at least one top cylinder mounted in the horizontal portion of the corner tracker and at least one edge cylinder mounted in the vertical portion of the edge tracker, wherein the axis of rotation of the at least one top cylinder and the axis of rotation of the at least one edge cylinder are perpendicular.

14. The tool of claim 12, wherein the workpiece marking implement is a knife having a blade, and wherein the pin is affixed to the blade.

15. The tool of claim 12, wherein the workpiece marking implement is a writing implement or a writing implement holder, and where the pin is affixed to the writing implement or the writing implement holder.

16. The tool of claim 12, wherein the corner tracker further comprises a calibration system providing for a precise measurement from the edge surface of the workpiece to the marking implement.

17. The tool of claim 12, further comprising a second pin affixed to and extending from the marking device on an opposite side from the first pin.

18. The tool of claim 12, wherein the pin comprises a neck portion and a head portion, and wherein the end tab comprises a horizontal portion and a vertical portion, wherein the horizontal portion of the end tab includes a slot for receiving the head portion of the pin therethrough, and the vertical portion of the end tab includes a slot for receiving the neck portion of the pin therein.

19. The tool of claim 18, wherein the vertical slot allows for rotational movement of the marking device relative to the measuring device about a rotational axis of the pin.

20. The tool of claim 12, wherein the vertical slot includes a plurality of notches for selectively engaging the pin at one of a plurality of depths in the slot.

* * * * *